United States Patent [19]

Wilkinson

[11] Patent Number: 4,573,295

[45] Date of Patent: Mar. 4, 1986

[54] SET OF BUILDING ARTICLES AND METHOD OF MAKING AND USING THE SET TO CONSTRUCT A PREDESIGNED, PRE-ENGINEERED STRUCTURE

[76] Inventor: Rudolph P. Wilkinson, 1021 Osage St., Ardmore, Okla. 73401

[21] Appl. No.: 620,397

[22] Filed: Jun. 13, 1984

[51] Int. Cl.[4] ..... E04B 2/100

[52] U.S. Cl. ..... 52/105; 52/747

[58] Field of Search ..... 52/105; 434/74; 52/585, 52/741, 742

[56] References Cited

U.S. PATENT DOCUMENTS

| | | | |
|---|---|---|---|
| 699,537 | 5/1902 | Lahmann . | |
| 979,913 | 12/1910 | Ault . | |
| 1,503,931 | 8/1924 | Wightman . | |
| 1,552,077 | 9/1925 | Palanti . | |
| 2,474,654 | 6/1949 | Carlson | 52/105 |
| 3,076,293 | 2/1963 | Baudoux . | |
| 3,137,967 | 6/1964 | Flieth | 52/105 |
| 3,391,507 | 7/1968 | Downing | 52/585 |
| 3,410,044 | 11/1968 | Moog . | |
| 3,628,232 | 12/1971 | Brewer | 52/105 |
| 3,888,060 | 6/1975 | Haener . | |
| 3,962,842 | 6/1976 | Wilhelm . | |
| 4,031,678 | 6/1977 | Schuring . | |
| 4,110,053 | 8/1978 | Buchholz | 52/585 |

*Primary Examiner*—John E. Murtagh

*Attorney, Agent, or Firm*—E. Harrison Gilbert, III

[57] ABSTRACT

A plurality of different types of building blocks are fabricated to include a respective coding for each different type, which coding in the preferred embodiment is a color pigmentation. Associated with the building blocks is a pattern marked with indicia which define, by full-scale markings, locations of the lowermost building elements of the predesigned, pre-engineered structure to be constructed by the present invention. Associated with the coded building materials and pattern is a coded diagram depicting the completed predesigned, pre-engineered structure by means of coded objects, coded in correspondence with the coded building materials, showing the numbers and location of each type of building material within the structure. The manufacturing of a kit of these elements and the method of erecting the structure from such a kit are also disclosed.

19 Claims, 14 Drawing Figures

SET OF BUILDING ARTICLES AND METHOD OF MAKING AND USING THE SET TO CONSTRUCT A PREDESIGNED, PRE-ENGINEERED STRUCTURE

BACKGROUND OF THE INVENTION

This invention relates generally to a set of materials and method for building a structure and more particularly, but not by way of limitation, to a set of color-coded building blocks and methods of manufacturing and utilizing the same to erect a predesigned, pre-engineered wall.

Various construction materials, such as concrete blocks or bricks, with which a wall can be built are, of course, known. Some such known construction materials can be fit together with or without the use of cement. Furthermore, it is well known that plans, such as architectural plans, can be used for guiding the construction of the structure from the construction materials. However, these plans and materials often require skilled personnel to understand and use. Therefore, there is the need for a simplified method and set of materials by which people without the skills of an architect or bricklayer can erect a structure such as a wall.

SUMMARY OF THE INVENTION

The present invention meets this need by providing a novel and improved set of building materials and methods of making and utilizing them to erect a structure. The present invention combines simple-to-follow instructions with easy-to-use building materials.

Broadly, the set of building materials of the present invention includes a baseboard block, a standard block, and a top block. The baseboard block is connectible with the standard block, and the standard block is connectible with the top block. Each of the blocks has a respective indicium identical to a corresponding respective indicium contained on a diagram showing the location of each of the building materials in the structure to be built. The set of building materials also comprises a full-scale pattern for receiving the baseboard block. The pattern includes a substratum having indicia for defining the location at which the baseboard block is to be received on the pattern. Other types of blocks having respective indicia corresponding to ones shown in the diagram are included within the set of building materials of the present invention.

The method of the present invention broadly comprises the steps of placing the pattern on a foundation where the structure is to be erected, which pattern has one or more indicia defining one or more locations at which a predetermined number of the baseboard blocks are to be placed; placing one of the baseboard blocks on the pattern in correspondence with a respective one of the indicia on the pattern and in correspondence with a respective first-coded object shown in the coded diagram depicting the structure to be erected; repeating the previous step until a lowermost course of the baseboard blocks is erected on the pattern in correspondence with the coded diagram; selecting respective ones of the standard blocks and the top blocks in correspondence with second-coded and third-coded objects illustrated in the diagram; and placing respective ones of the standard blocks and the top blocks above the lowermost course of baseboard blocks so that the respective ones of the standard blocks and top blocks are located within the structure at places corresponding to locations depicted in the diagram. The method also broadly includes utilizing other types of blocks with which other construction elements, such as furring members, baseboards and plumbing or electrical fixtures, can be used. Also included in the method of the present invention are steps by which a frame is disposed within an opening defined in the structure.

The present invention also provides a method of manufacturing a kit for building a predesigned, pre-engineered structure having at least three different structural elements including a bottom building block (such as the aforementioned baseboard block), a middle building block (such as the aforementioned standard block) and a top building block (such as the aforementioned top block). This method comprises the steps of assigning a first color to the bottom building block; assigning a second color to the middle building block; assigning a third color to the top building block; placing first indicia on a first substratum showing the numbers and locations of the structural elements within the structure, the first indicia including a first object having the first color for representing the bottom building block, a second object having the second color for representing the middle building block, and a third object having the third color for representing the top building block; placing second indicia on a second substratum showing the relative full-scale positions of a plurality of the bottom building blocks to be used in constructing a lowermost portion of the structure, the second substratum being disposable upon a foundation on which the structure is to be built; fabricating a number of the bottom blocks, including the step of pigmenting the bottom blocks with the first color, the number of bottom building blocks being not less than the number of the bottom building blocks represented in the diagram; fabricating a number of the middle building blocks, including the step of pigmenting the middle building blocks with the second color, the number of middle building blocks being not less than the number of the middle building blocks represented in the diagram; and fabricating a number of the top building blocks, including the step of pigmenting the top building blocks with the third color, the number of top building blocks being not less than the number of the top building blocks represented in the diagram.

Therefore, from the foregoing, it is a general object of the present invention to provide a novel and improved set of building materials and methods of making and utilizing the same for constructing a predesigned, pre-engineered structure. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 14:
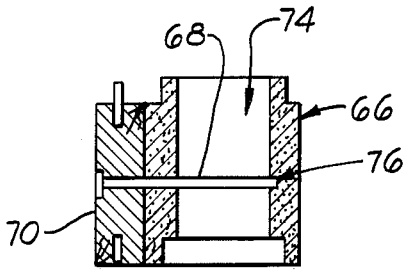
FIG. 14 is a vertical cross-sectional view showing a framing element pinned to a half-size block.
Figure 11:
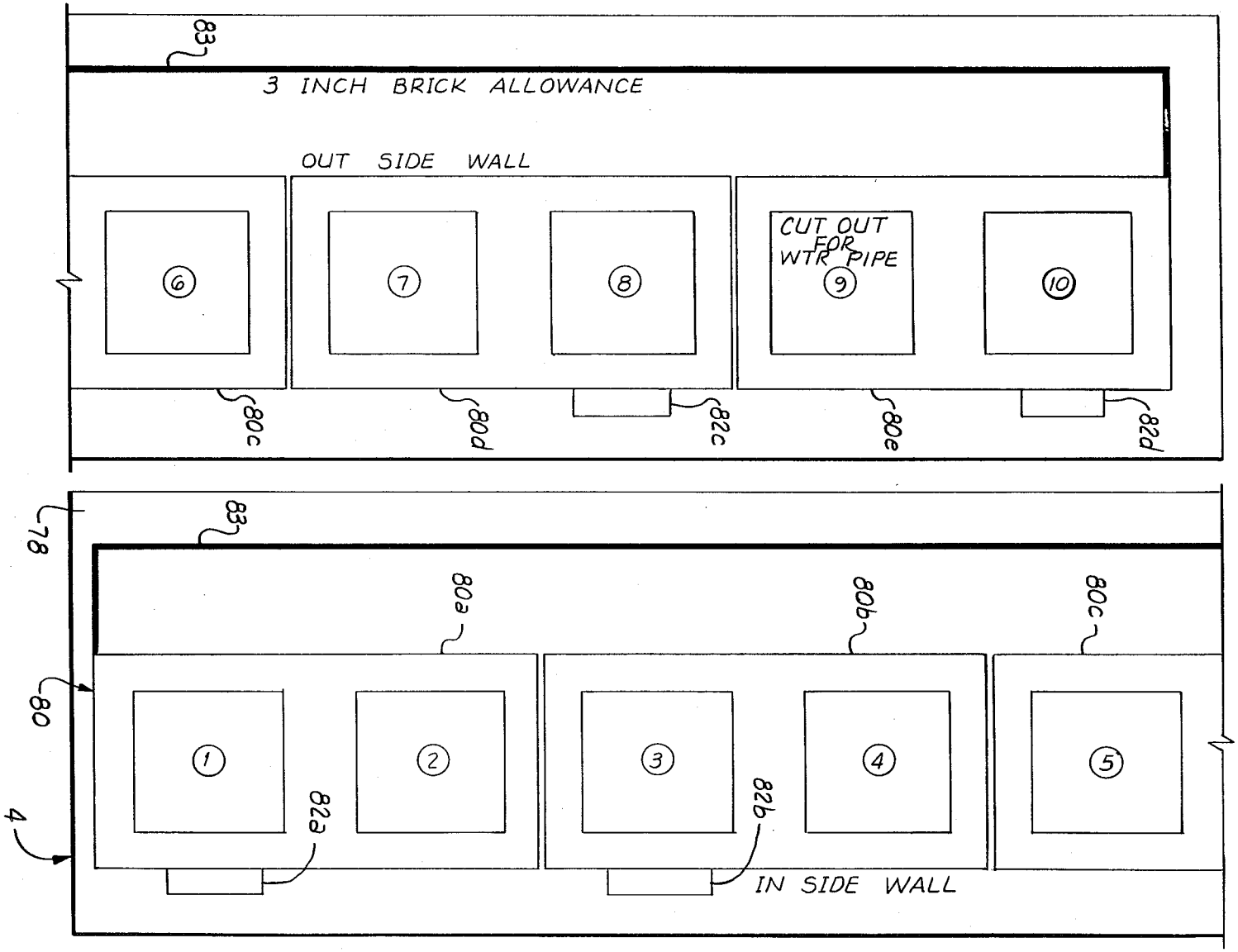
FIG. 11 is a plan view of a pattern constructed in accordance with the present invention.
Figure 12:
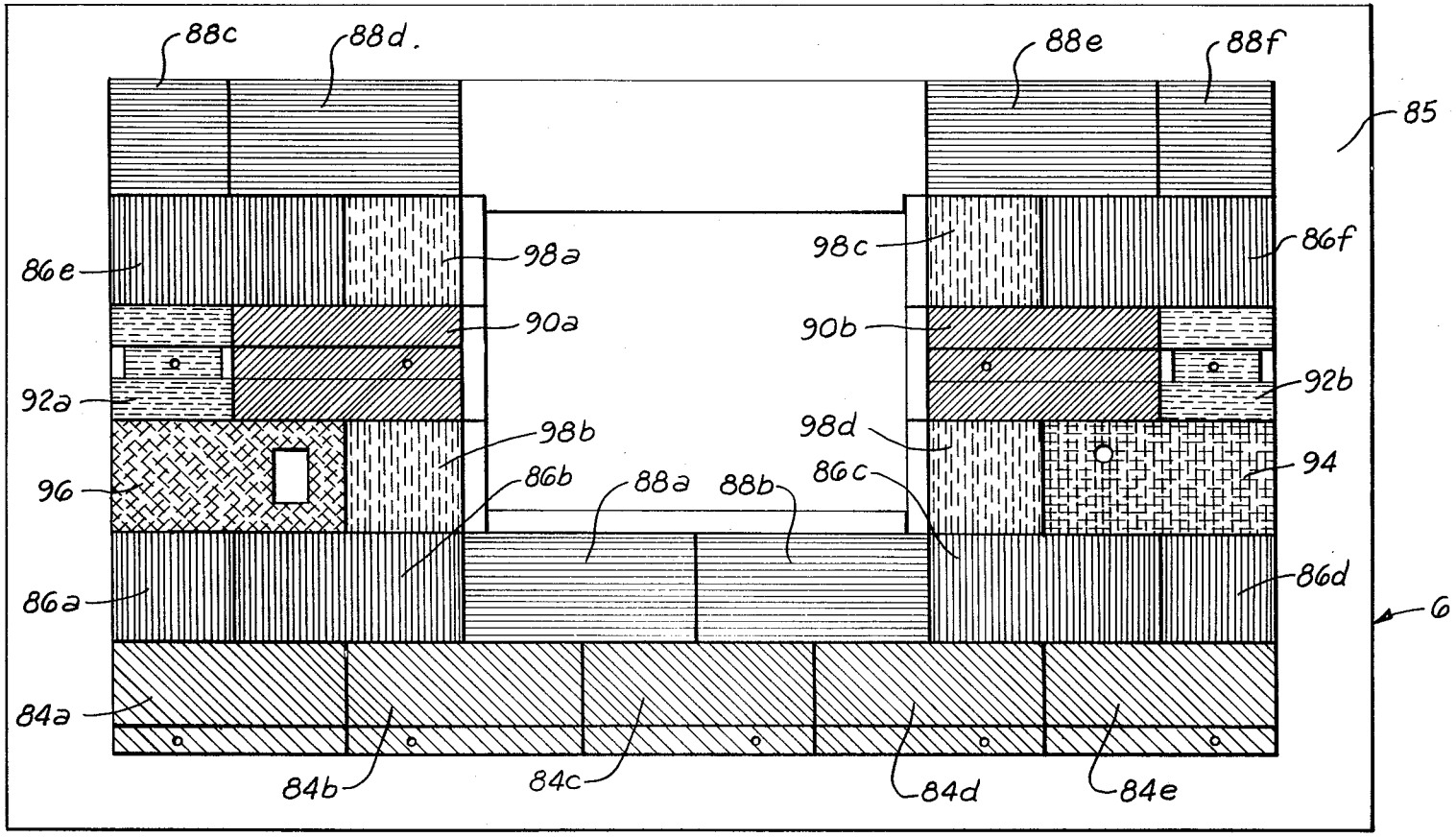
FIG. 12 is a front view of a color-coded diagram constructed in accordance with the present invention.
Figure 13:
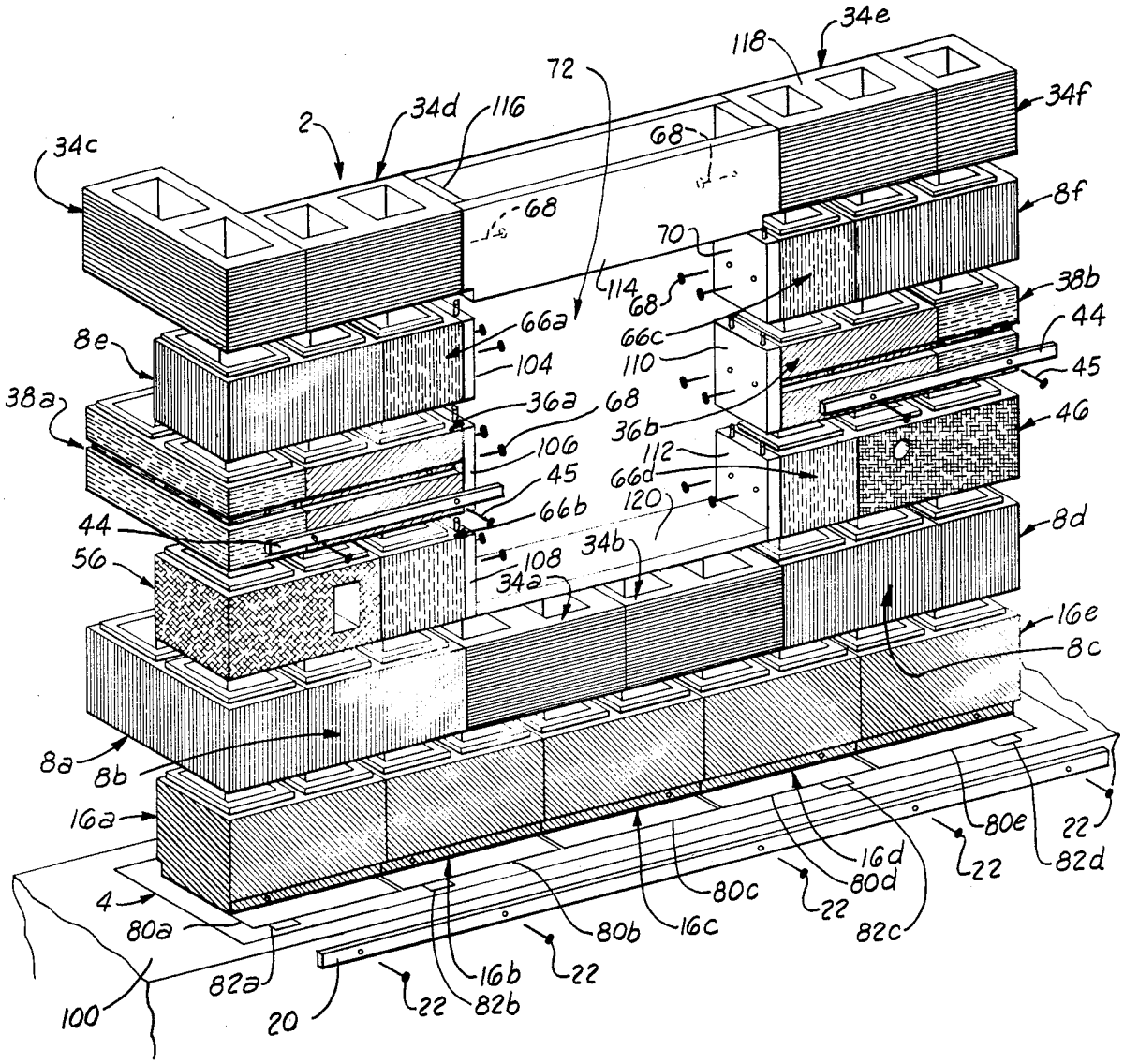
FIG. 13 is an exploded isometric view of a predesigned, pre-engineered wall constructed in accordance with the present invention.

With reference to the drawings, the preferred embodiment of the present invention will be described. Generally, FIG. 13 shows an exploded view of a predesigned, pre-engineered wall 2 made from the set of materials and with the methods of the present invention. FIGS. 1–10 depict the respective preferred embodiment of each of the building blocks of which the wall 2 is made. These blocks are described in my copending U.S. patent application Ser. No. 467,709, filed Feb. 18, 1983, and incorporated herein by reference. FIG. 11 depicts a pattern 4 upon which the building blocks are placed in constructing the wall 2. FIG. 12 shows a coded diagram 6 which is used to direct the construction of the wall 2. FIGS. 13 and 14 show other construction elements, such as furring strips, a baseboard, and frame members which will be described hereinbelow.

Figure 1:
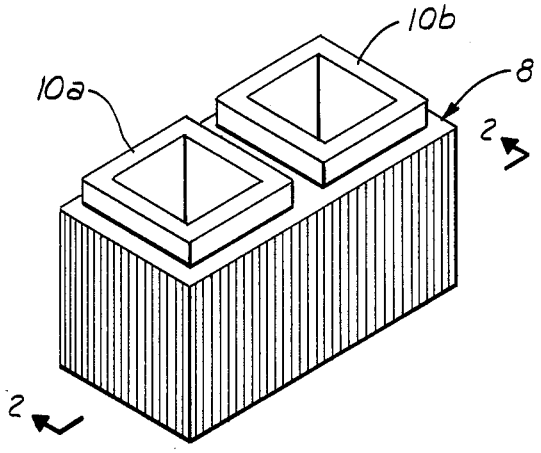
FIG. 1 is an isometric view of a standard building block of the present invention.
Figure 2:
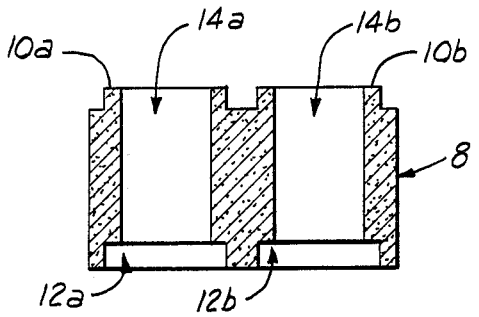
FIG. 2 is a vertical cross-sectional view taken along line 2—2 shown in FIG. 1.

The preferred embodiment of a standard block 8 is shown in FIGS. 1 and 2. FIG. 13 shows that a plurality of standard blocks 8*a*, 8*b*, 8*c*, 8*d*, 8*e*, 8*f* are used in the middle of the wall 2 within intermediate courses of the building materials. The standard block 8 has a generally rectangular shape in cross section, but with upstanding rims 10*a*, 10*b* and inwardly extending depressions 12*a*, 12*b* formed on top and bottom surfaces, respectively, around the peripheries of two cavities or openings 14*a*, 14*b* extending through the height of the block 8. The openings 14*a*, 14*b* are parallel to and spaced from each other as shown in the drawings. The rims 10*a*, 10*b* and the depressions 12*a*, 12*b* are complementally shaped so that a rim of a lower standard block nests or mates with a depression of an upper standard block or other type of block as will be subsequently described. With this construction of rims and depressions, the building blocks of the present invention can be interconnected one with the other without the use of cement or other mortar-like compound.

The standard block 8 is made of any suitable material, such as concrete or plastic. Regardless of the material of construction, the material used in fabricating the preferred embodiment block 8 has a pigmentation (such as paint, dye or other suitable pigmenting substance as known to the art) included therewith for giving to the standard block 8 a respective indicium distinguishing it from the other types of blocks to be described hereinbelow. As illustrated in FIG. 1, the indicium of the preferred embodiment is a pigmentation which gives a red color to the sides of the block 8. This red color is depicted by the vertical drafting marks shown in FIG. 1 on the sides of the block. (It is to be noted that the drafting marks used in the drawings to represent color are the marks shown in former 37 C.F.R. 3.61, found on page 102 of the 1979 edition of Title 37 of the Code of Federal Regulations published by the Office of the Federal Register, National Archives and Records Service, General Services Administration.)

Figure 3:
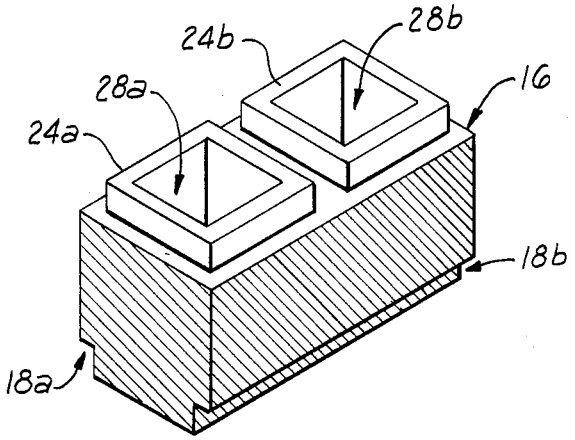
FIG. 3 is an isometric view of a side baseboard block of the present invention.

FIG. 3 shows the preferred embodiment of a side baseboard block 16 having a shape and size similar to the standard block 8, except for notches 18*a*, 18*b* defined along the bottom side edges of the block 16. The baseboard block 16 is used at the bottom of the wall 2 as depicted in FIG. 13 by the blocks 16*a*–16*e* so that a baseboard 20 can be retained in the notches 18 such as by pins 22 shown in FIG. 13. As with the standard block 8, the baseboard block 16 includes rims 24*a*, 24*b* and depressions (not shown) on opposite ends of cavities 28*a*, 28*b* (although given different numerals in this description, the rims, depressions and cavities of the preferred embodiment blocks are the same size and shape so that nesting between different types of the blocks is accommodated). The cavities 28*a*, 28*b* (as well as the cavities 14*a*, 14*b* and the cavities of the other types of blocks described hereinbelow) are constructed for receiving a support structure or support substance, such as concrete, as will be more particularly described hereinbelow. The baseboard block 16 is illustrated as having a green pigmentation as its indicium distinguishing it from the other types of blocks in the set of building blocks of the preferred embodiment of the present invention.

Figure 4:
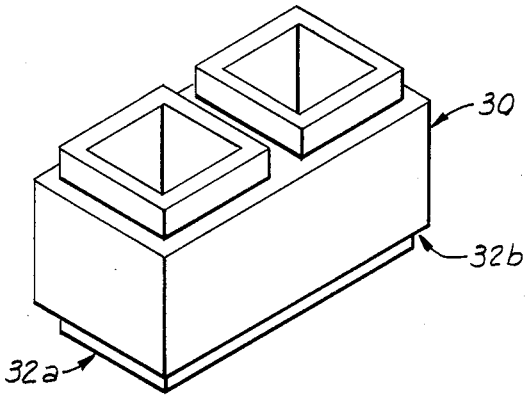
FIG. 4 is an isometric view showing an end baseboard block of the present invention.

FIG. 4 discloses a corner baseboard block 30 having side notches, which are similar to the notches 18*a*, 18*b*, as well as notches 32*a*, 32*b* defined in the ends of the block 30. These two sets of notches enable the block 30 to be positioned at a corner of the structure so that baseboards extending along the bottoms of the two surfaces which include a side and an end of the block 30 can be used. Although not shown in FIG. 4, the preferred embodiment block 30 is to be assigned a respective color coding to distinguish it from the other types of building blocks of the present invention.

Figure 5:
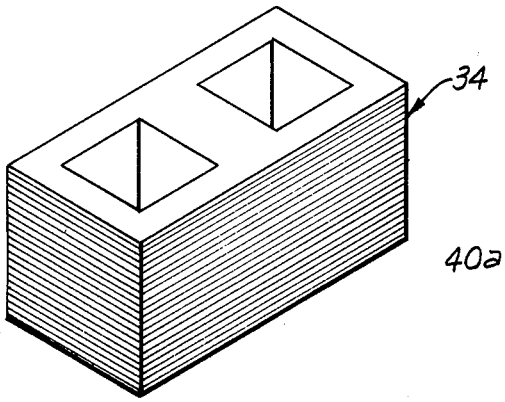
FIG. 5 is an isometric view of a top block of the present invention.

FIG. 5 shows a top block 34 of the present invention. The top block 34 is constructed similarly to the previously described types of blocks; however, the top block 34 does not include any upwardly extending rims so that it has a flat upper surface. The top block 34 does include depressions (not shown) similar to those shown in FIG. 2 for receiving upwardly protruding rims from blocks disposed beneath the top block 34. The top block 34 is shown in FIG. 5 to have a blue color coding as its indicium for distinguishing it from the other types of construction blocks of the preferred embodiment of the present invention.

Figure 6:
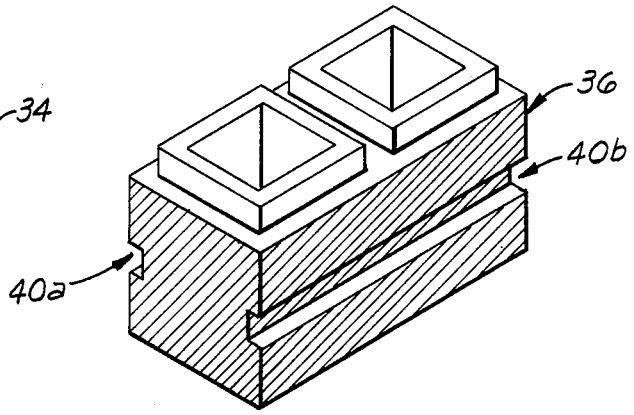
FIG. 6 is an isometric view of a side furring block of the present invention.
Figure 7:
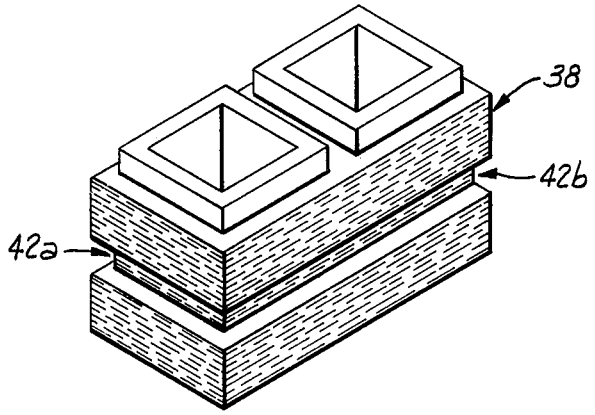
FIG. 7 is an isometric view of an end furring block of the present invention.

FIGS. 6 and 7 illustrate two different types of furring blocks 36, 38. The side furring block 36 shown in FIG. 6 has longitudinal slots 40*a*, 40*b* defined in respective ones of the longer sides of the block 36. The end furring block 38 shown in FIG. 7 has, in addition to the side slots similar to the slots 40*a*, 40*b*, end slots 42*a*, 42*b* which intersect the side slots. These slots are for receiving furring strips 44 and fasteners, such as pins 45, as illustrated in FIG. 13. The furring strips 44 are of a suitable material for receiving nails, screws or other fastening devices so that other materials, such as wallboards, can be attached to the wall 2. The furring blocks 36, 38 include upwardly extending rims and inwardly extending depressions of types similar to those previously described with reference to the blocks 8, 16, 30. In the illustrated preferred embodiment the block 36 includes a brown pigmentation to distinguish it from the other types of blocks, and the block 38 includes a gray pigmentation to distinguish it.

Figure 8:
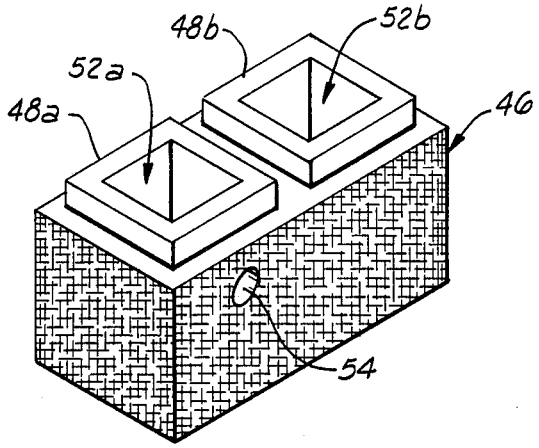
FIG. 8 is an isometric view of one type of utility block for receiving a plumbing element.

FIG. 8 depicts one type of utility block of the present invention. In particular, FIG. 8 shows a plumbing block 46 having upwardly extending rims 48*a*, 48*b* and inwardly extending depressions (not shown) of types as previously described. These structures are on opposite ends of openings 52*a*, 52*b* extending through the height of the block 46. Defined through at least one of the side walls of the block 46 is a hole 54 which communicates the exterior of the block with the interior of one of the openings, such as the opening 52*a*. The hole 54 has a sufficient size for receiving a plumbing outlet member, such as a conduit (not shown). An example of a plumbing arrangement utilizing the plumbing block 46 is illustrated in my aforementioned U.S. patent application. As shown in FIG. 8 of the present application, the plumbing block 46 has a yellow pigmentation for distinguishing it from the other types of blocks in the preferred embodiment.

Figure 9:
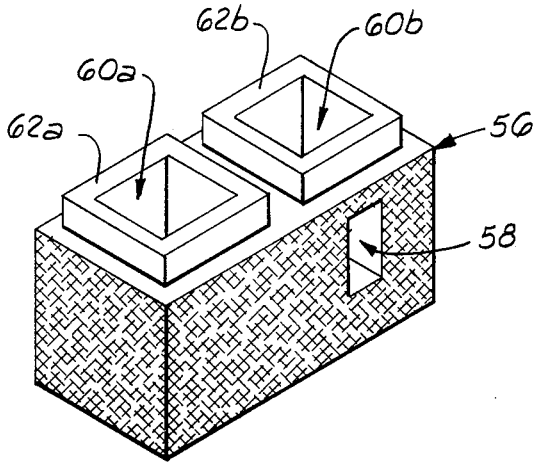
FIG. 9 is an isometric view of another type of utility block for receiving an electrical outlet box.

FIG. 9 shows another type of utility block, namely, an electrical outlet block 56 having a cavity 58 defined in a side wall. The cavity 58 communicates with one of two cavities 60*a*, 60*b* which extend through the block and which are bounded by rims 62*a*, 62*b* and depressions (not shown) of types as previously described. The cavity 58 is configured for receiving an electrical outlet box which supports an electrical outlet of types as known to the art. FIG. 9 shows that the electrical outlet block 56 includes an orange pigmentation to distinguish it from the other types of blocks of the preferred embodiment of the present invention.

Figure 10:
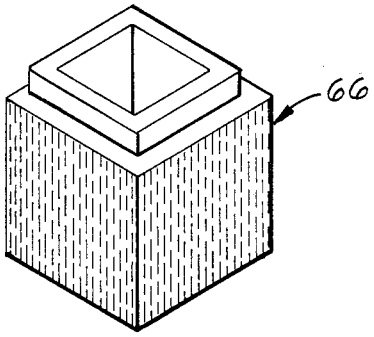
FIG. 10 is an isometric view of a half-size block of the present invention.

FIG. 10 illustrates the preferred embodiment of a half-size block 66, which is also referred to in a specific use of the block 66 as a jamb block. Reference as a jamb block is made in view of its depicted use in the wall 2 shown in FIG. 13. In such use, the block 66 is modified to include holes for receiving pins 68 extending through a frame element 70 which defines part of a frame in an opening 72 (specifically, a window frame in a window opening) through the wall 2 as shown in FIG. 13. A more detailed view of the association between the frame element 70 and the block 66, which elements are connected by the pins 68, is shown in the sectional view of FIG. 14. As shown in FIG. 14, the pins 68 extend through the holes in the block 66 across a cavity 74 thereof and into a pin-receiving space 76 formed in the opposite wall of the block 66. Referring to FIG. 10, the block 66 is shown to have a violet pigmentation for distinguishing it from the other types of blocks of the preferred embodiment of the present invention.

Each of the previously described blocks, except for the jamb block 66, is constructed in the preferred embodiment of the same basic material and the same size so that each block can be interconnected with each other block in the offsetting manner illustrated in FIG. 13 to construct the wall 2. The jamb block 66 is made of the same basic material, but it is approximately one-half the size of the remaining blocks so that it can be used in filling half-space gaps occurring at certain ends due to the overlapping construction. As previously described, each type of block includes its own respective coding means, specifically a respective pigmentation in the preferred embodiment.

FIG. 11 shows a plan view of the pattern 4 forming another part of the present invention. The pattern 4 of the preferred embodiment is a full-scale layout including a substratum 78 made of a suitable material, such as a sheet of paper, having at least two types of indicia placed or otherwise disposed thereon. One type of indicia is represented by rectangular boxes 80 which outline full-scale outlines for the bottom or baseboard blocks 16 and the cavities defined therein. Therefore, the indicia 80 provide full-scale depictions of the locations of the baseboard blocks 16. For the llustrated embodiment, there are five defined locations for the blocks 16 designated by the indicia 80*a*, 80*b*, 80*c*, 80*d*, 80*e*. The second type of indicia shown on the substratum 78 includes the smaller rectangular boxes 82*a*, 82*b*, 82*c*, 82*d* which define support-receiving portions of the baseboard blocks 16. For the preferred embodiment, the indicia 82*a*, 82*b*, 82*c*, 82*d* indicate those sections of the baseboard blocks having cavities which are to receive liquid cement after the wall 2 is erected. Other indicia contained on the substratum 78 include a "3-inch brick allowance" mark 83, specifying where a brick facade can be erected, and "inside" and "outside" wall indications.

FIG. 12 illustrates the coded diagram 6 which shows the numbers and locations of the building blocks by means of a plurality of indicia representing the different types of building blocks of the present invention. Each indicium of the preferred embodiment of the diagram 6 is contained on a substratum 85 made of a suitable material, such as paper. In the preferred embodiment, each indicium includes a color-coded object which is a graphic depiction of a respective one of the different types of the aforementioned building materials. For example, green color-coded rectangles 84*a*, 84*b*, 84*c*, 84*d*, 84*e* represent five baseboard blocks 16. Rectangles 86*a*, 86*b*, 86*c*, 86*d*, 86*e*, 86*f* coded with the color red represent the six standard blocks 8 to be used in constructing the wall 2. Likewise, other coded rectangles represent other ones of the building blocks (i.e., blue-colored rectangles 88*a*, 88*b*, 88*c*, 88*d*, 88*e*, 88*f* represent six top blocks 34; brown-colored rectangles 90*a*, 90*b* represent two side furring blocks 36; gray-colored rectangles 92*a*, 92*b* represent two end furring blocks 38; a yellow-colored rectangle 94 represents one plumbing block 46; an orangecolored rectangle 96 represents one electrical outlet block 56; violet-colored rectangles 98*a*, 98*b*, 98*c*, 98*d* represent four jamb blocks 66). As will be noted upon reviewing FIG. 12 with the other figures showing the building blocks, the coding in the diagram 6 is the same as or corresponds to the color pigmentations with which the actual building blocks are constructed. In the preferred embodiment of the present invention, at least three different colored objects, such as the rectangles or boxes 84, 86, 88, are contained in the diagram. In other words, the preferred embodiment of the present invention includes at least the baseboard blocks 16 and their corresponding color-coded designations in the diagram 6 and the locating indicia contained on the pattern 4, as well as the standard blocks 8 used in the middle of the wall 2 and the top blocks 34 used along the top of the wall 2 and their color-coded depictions in the diagram 6.

Although not shown in the drawings, an audiovisual means can be used with the present invention. For the illustrated preferred embodiment, the audiovisual means is a video tape giving pictorial and oral instructions for using the pattern 4, the diagram 6 and the building materials to construct the predesigned, pre-engineered wall 2.

Through the construction and assemblage of the aforementioned elements, one obtains a kit for building a predesigned, pre-engineered structure. Thus, the present invention also contemplates a method of making or manufacturing such a kit, which kit in the preferred embodiment has at least three different structural elements including one or more of the baseboard or bottom building blocks, one or more of the standard or middle building blocks and one or more of the top building blocks. This method of manufacturing includes the steps of assigning some type of coded indentifier to each of the different types of structural elements included in the kit. In the preferred embodiment this includes assigning a first color to the bottom building block, assigning a second color to the middle building block, and assigning a third color to the top building block. For additional structural elements used in the practicing of the method, additional colors are assigned to each of the different types.

Also included within this method of manufacture is the step of creating the coded diagram by which the predesigned, pre-engineered structure is to be built. This includes placing indicia on a substratum, such as a sheet of paper, showing the numbers and locations of each of the structural elements within the structure. In the preferred embodiment the indicia include at least a first object having the first color for representing one bottom building block, a second object having the second color for representing one middle building block, and a third object having the third color for representing the top building block. Additional indicia can be used to designate additional ones of these blocks or to designate other types of blocks.

The method of manufacturing the kit also includes creating the pattern upon which the bottom building blocks are placed. This includes placing other indicia on another substratum, such as a sheet of paper, showing the relative full-scale positions of a plurality of the bottom building blocks to be used in constructing a lowermost portion of the predesigned, pre-engineered structure. This substratum is disposable upon a foundation on which the structure is to be built. An example of such a foundation is illustrated in FIG. 13 and identified by the reference numeral 100.

The method of manufacturing the kit further comprises the steps of fabricating, such as in a general manner as known to the art, a number of each of the required structural elements which, in the preferred embodiment, include at least one bottom baseboard building block 16, one middle standard building block 8, and one top building block 34. A number of the bottom building blocks 16 is fabricated, which number is not less than the number of the bottom building blocks represented in the diagram 6. Likewise, the number of the middle building blocks 8 fabricated is not less than the number of the middle building blocks represented in the diagram 6, and the number of the top building blocks 34 fabricated is not less than the number of the top building blocks represented in the diagram. In the preferred embodiment, each fabricating step by which one or more of these building blocks is made includes the specific step of pigmenting the respective block with the respective color, such as by mixing a suitable dye with the material from which the respective blocks are to be made.

The making of this kit also includes producing the aforementioned video tape showing a person using the pattern, the diagram and the building blocks to erect the predesigned, pre-engineered structure. Once such a kit is made, it can be marketed as a single product by which the predesigned, pre-engineered structure can be built.

With such a kit as is manufactured by the aforementioned method of the present invention, one can practice the present invention's further method of erecting a structure from such set of building materials. Generally, this method comprises the steps of placing the pattern 4 on the foundation 100 where the structure, such as the wall 2, is to be erected. The pattern 4, as previously described, includes the full-scale indicia defining the locations at which a predetermined number of the bottom or baseboard blocks 16 are to be placed within the predesigned, pre-engineered structure.

The method further includes the step of placing one of the baseboard blocks 16 on the pattern 4 in correspondence with a respective one of the indicia contained on the pattern 4 and further in correspondence with a respective one of the similarly coded objects shown in the diagram 6. With respect to the preferred embodiment of the elements illustrated in the drawings, this step includes selecting one of the colored building blocks having a color corresponding to a selected colored object positioned at the base of the wall depicted in the diagram 6 and then placing the selected colored building block on the pattern 4 over one of the indicia located in correspondence with the selected colored object positioned at the base of the wall shown in the diagram 6. For example, one practicing the method of the present invention would note the green-colored rectangle 84*a* at the lower left corner of the wall depicted in the diagram 6 and, therefore, would select one green-colored baseboard block 16*a* and place it on the pattern 4 over the full-scale indicium 80*a* contained on the substratum 78 of the pattern 4, thereby forming the lower left corner of the wall 2 as illustrated in FIG. 13. The foregoing steps associated with the lowermost portion of the wall are repeated until a lowermost course of the baseboard blocks 16 (constructed of the blocks 16*a*, 16*b*, 16*c*, 16*d*, 16*e* in the FIG. 13 embodiment) is erected on the pattern 4 in correspondence with the coded diagram 6 and the indicia on the pattern 4.

Another of the colored building blocks having another color corresponding to another selected colored object shown in the diagram 6 to be positioned above the base of the structure is selected and placed above the lowermost course of the building blocks in correspondence with such other selected colored object shown in the diagram 6. Similarly, a third type of colored building block having a third color corresponding to a further selected one of the colored objects shown in the diagram 6 to be positioned at the top of the structure is selected and placed above the second selected ones. These steps are repeated until a plurality of intermediate courses and an uppermost course of the building blocks are formed. These second and third types of blocks correspond in the preferred embodiment to the standard blocks 8 and the top blocks 34 which are used as blocks 8*a*, 8*b*, 8*c*, 8*d*, 8*e*, 8*f* and blocks 34*a*, 34*b*, 34*c*, 34*d*, 34*e*, 34*f*, respectively, in the wall 2 depicted in FIG. 13 and which are represented in the diagram 6 shown in FIG. 12 by the color-coded objects 86*a*, 86*b*, 86*c*, 86*d*, 86*e*, 86*f* and the color-coded objects 88*a*, 88*b*, 88*c*, 88*d*, 88*e*, 88*f*, respectively.

With respect to the illustrated preferred embodiment, this method of erecting a structure includes additional steps pertaining to utilization of the additional types of building materials shown as being used in the construction of the wall 2 illustrated in FIG. 13. These additional steps comprise inserting into at least one of the intermediate courses (or themselves defining an intermediate course) one or more of the furring blocks 36, 38 having slots 40, 42 defined therein for receiving one or more of the furring members 44 (the diagram 6 depicted in FIG. 12 shows color-coded objects 90*a*, 90*b* and 92*a*, 92*b* representing the blocks 36*a*, 36*b* and 38*a*, 38*b*, respectively, used in the wall 2 illustrated in FIG. 13). The method further comprises the steps of placing at least one of the furring members 44 in the slots 40, 42 and inserting at least one of the pins 45 through holes defined in the furring member 44 and at least one of the furring blocks 36, 38 and into an opening defined in the furring block such as by an arrangement similar to the one illustrated in FIG. 14. The association of the furring members, pins and furring blocks within the wall 2 is depicted, in an exploded view, in FIG. 13.

In a manner similar to the connecting of the furring member 44 to the furring blocks 36, 38, the baseboard 20 can be connected by the pins 22 to the notch or groove defined along the bottom edge of the building blocks 16*a*, 16*b*, 16*c*, 16*d*, 16 *e* forming the lowermost course. This is also exemplified in FIG. 13.

Still further, the method of the present invention by which a structure such as the wall 2 is erected includes the step of framing the opening 72 defined in the intermediate courses of the structure. This step of framing more particularly includes placing a first frame member adjacent the building blocks defining a first side of the opening. With respect to the illustrated embodiment shown in FIG. 13, the first frame member comprises frame elements 104, 106, 108, which elements in the preferred embodiment are wood blocks. Once these blocks are placed adjacent the illustrated building blocks, the pins 68 are placed through holes defined in each of the frame elements 104, 106, 108 and respective pin-receiving ones of the building blocks defining the first side of the opening 72 and into the respective cavity or opening of the pin-receiving blocks. For the embodiment shown in FIG. 13, the frame element 104 is pinned to the jamb block 66*a*, the frame element 106 is pinned to the furring block 36*a*, and the frame element 108 is pinned to the jamb block 66*b*.

The method of framing the opening further comprises the steps of placing a second frame member (including the illustrated individual wood blocks or frame elements 70, 110, 112) adjacent the building blocks defining a second side of the opening 72, and inserting one or more other pins 68 through holes defined in each of the frame elements 70, 110, 112 and respective other pin-receiving ones of the building blocks defining the second side of the opening and into the cavities or openings thereof. For the illustrated embodiment of FIG. 13, the frame element 70 is pinned to the jamb block 66*c*, the frame element 110 is pinned to the furring block 36*b*, and the frame element 112 is pinned to the jamb block 66*d*.

With the two sides of the opening framed, a header frame member 114 is placed on top of the first and second frame members. One or more other pins 68 are inserted through holes defined in a first end 116 of the header frame member 114 and an additional pin-receiving one of the building blocks defining the first side of the opening and into the cavity of such block. In the illustrated embodiment of FIG. 13, the end 116 is pinned to the top block 34*d*. One or more additional pins 68 are inserted through holes defined in a second end 118 of the header frame member 114 and a further pin-receiving one of the building blocks defining the second side of the opening and into the cavity thereof. In the illustrated embodiment, the end 118 is pinned to the top block 34*e*.

The framing of the illustrated opening 72 also includes mounting a sill frame member 120 between the lower ends of the frame elements 108, 112 and on top of the blocks 34*a*, 34*b* as shown in FIG. 13. In the preferred embodiment the sill frame member 120 is nailed or pinned to the frame elents 108, 112.

Also shown in FIG. 13 are vertical pins extending from each of the frame elements 104, 106, 108, 70, 110, 112. These pins are received in complementally shaped holes (not shown) defined in the lower edges of the frame elements and the header frame member.

Although the opening 72 is shown and described as a window opening, other types of openings (such as a door opening, for example) can be framed by the method of the present invention.

As shown in FIG. 12, the frame elements of the preferred embodiment are depicted in the diagram 6.

The method of the present invention still further comprises the step of pouring liquid cement into one or more of the cavities or openings defined through the building blocks. With respect to the preferred embodiment, the cavities to be filled are those which are vertically alighed with the indicia 82*a*, 82*b*, 82*c*, 82*d* on the pattern 4. From the nature of the offset stacking and size and shape of the building blocks of the present invention, an open column throughout the height of the wall 2 is defined at each of the indicia 82*a*, 82*b*, 82*c*, 82*d* marked on the substratum 78 of the pattern 4. In addition to or alternatively to pouring liquid cement at the locations designated on the pattern 4, liquid cement can be poured into those cavities which received pins connecting the furring strips, baseboards or frame elements with the respective building blocks. When such liquid cement hardens, it will more securely connect these respective elements together. That such securement will occur can be perceived by envisioning concrete disposed in the cavity 74 of the building block 66 shown in FIG. 14.

To further assist one in using the kit made by means of the method of the present invention, the audiovisual means can be examined prior to or duing the use of the kit and the practicing of the last described method of erecting the predesigned, pre-engineered structure. In the preferred embodiment, this audio visual means includes a video tape showing a person using the diagram 6, the pattern 4 and the plurality of building blocks described hereinabove to assemble the structure.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A set of a plurality of types of building materials for constructing a predesigned, pre-engineered structure on a foundation, comprising:

a diagram including a plurality of indicia defining the location of each of the building materials in the structure and further defining the type of building material to be used at the defined location;

a baseboard block having a first indicium identical to a first one of the plurality of indicia included on said diagram;

a standard block, connectible with said baseboard block, having a second indicium identical to a second one of the plurality of indicia included on said diagram;

a top block, connectible with said standard block, having a third indicium identical to a third one of the plurality of indicia included on said diagram; and a full-scale pattern, separate from said baseboard block and the foundation upon which the structure is to be constructed, for receiving said baseboard block after said pattern has been placed on the foundation where the structure is to be constructed, said pattern including a substratum having indicia thereon defining the location at which said baseboard block is to be received.

2. A set as defined in claim 1, further comprising a furring block, connectible with said standard block, having a fourth indicium identical to a fourth one of the plurality of indicia included on said diagram.

3. A set as defined in claim 2, further comprising a jamb block, connectible with said standard block, having a fifth indicium identical to a fifth one of the plurality of indicia included on said diagram.

4. A set as defined in claim 3, wherein:

each of said baseboard block, standard block, top block and furring block has a predetermined first size; and said jamb block has a predetermined second size smaller than said first size.

5. A set as defined in claim 3, further comprising a utility block, connectible with said standard block, having a sixth indicium identical to a sixth one of the plurality of indicia included on said diagram.

6. A set as defined in claim 1, wherein each of said first indicium, second indicium and third indicium includes a different respective pigmentation defining a different respective color.

7. A set as defined in claim 1, wherein said substratum has additional indicia for defining support-receiving portions of said baseboard block, said standard block and said top block when said blocks are mounted one on top of another.

8. A method of erecting a structure from a set of building materials including baseboard blocks, standard blocks and top blocks, which structure is shown in a coded diagram having a first-coded object representing said baseboard blocks, a second-coded object representing said standard blocks, and a third-coded object representing said top blocks, said method comprising the steps of:

(a) placing a pattern on a foundation where the structure is to be erected, said pattern including a sheet of paper having indicia defining locations at which a predetermined number of said baseboard blocks are to be placed;

(b) placing one of said baseboard blocks on said pattern is correspondence with a respective one of said indicia thereon and in correspondence with a respective one of the first-coded objects shown in said diagram;

(c) repeating step (b) until a lowermost course of said baseboard blocks is erected on said pattern in correspondence with said pattern and said coded diagram;

(d) selecting respective ones of said standard blocks and said top blocks in correspondence with the second-coded and third-coded objects shown in said diagram;

(e) placing said respective ones of said standard blocks and said top blocks above said lowermost course of baseboard blocks so that said respective ones of said standard blocks and said top blocks are located within the structure at places corresponding to locations depicted in said diagram.

9. A method of erecting, from a set of different types of building blocks wherein each different type of block has a respective color associated therewith, a predesigned, pre-engineered wall shown in a color-coded diagram wherein the different types of said building blocks are represented by corresponding different colored objects, there being at least three different colored objects shown in said diagram said method comprising the steps of:

(a) placing a pattern on a foundation, said pattern having indicia designating predetermined locations at which a first course of said building blocks is to be laid;

(b) selecting one of said colored building blocks having a color corresponding to a selected colored object positioned at the base of the wall depicted in said diagram;

(c) placing said one of said colored building blocks on said pattern over one of said indicia located in correspondence with said selected colored object positioned at the base of the wall depicted in said diagram;

(d) repeating steps (b) and (c) until a lowermost course of said building blocks is placed on said pattern in correspondence with the colored objects positioned at the base of the wall depicted in said diagram;

(e) selecting another of said colored building blocks having another color corresponding to another selected colored object positioned in said diagram above the base of the wall depicted therein;

(f) placing said another of said building blocks above said lowermost course of said building blocks in correspondence with said another selected colored object shown in said diagram;

(g) repeating steps (e) and (f) until a plurality of intermediate courses of said building blocks are erected on top of said lowermost course;

(h) selecting a further one of said colored building blocks having a further color corresponding to a further selected one of said colored objects positioned in said diagram at the top of the wall depicted therein;

(i) placing said further one of said building blocks above said intermediate courses of said building blocks in correspondence with said further selected one of said colored objects shown in said diagram; and (j) repeating steps (h) and (i) until an uppermost course of said building blocks is erected on top of said intermediate courses.

10. A method as defined in claim 9, further comprising the step of inserting into one of said intermediate courses a furring block having a slot defined therein for receiving a furring member.

11. A method as defined in claim 10, further comprising the steps of:

placing a furring member in said slot; and inserting a pin through holes defined in said furring member and said furring block and into an opening defined in said furring block.

12. A method as defined in claim 11, further comprising the step of pouring liquid cement into said opening in said furring block for fastening said pin therewith.

13. A method as defined in claim 10, wherein:

said intermediate courses have an opening defined therein; and said method further comprises the steps of:

placing a first frame member adjacent said building blocks defining a first side of said opening;

inserting a first pin through holes defined in said first frame member and a first pin-receiving one of said building blocks defining said first side of said opening and into a first cavity defined in said first pin-receiving block;

placing a second frame member adjacent said building blocks defining a second side of said opening;

inserting a second pin through holes defined in said second frame member and a second pin-receiving one of said building blocks defining said second side of said opening and into a second cavity defined in said second pin-receiving block;

placing a header frame member on top of said first and second frame members;

inserting a third pin through holes defined in a first end of said header frame member and a third pin-receiving one of said building blocks defining said first side of said opening and into a third cavity defined in said third pin-receiving block; and inserting a fourth pin through holes defined in a second end of said header frame member and a fourth pin-receiving one of said building blocks defining said second side of said opening and into a fourth cavity defined in said fourth pin-receiving block.

14. A method as defined in claim 13, further comprising the step of pouring liquid cement into said first, second, third and fourth cavities to fasten said first, second, third and fourth pins relative to said first, second, third and fourth pin-receiving blocks, respectively.

15. A method as defined in claim 9, wherein:

said intermediate courses have an opening defined therein; and said method further comprises the steps of:

placing a first frame member adjacent said building blocks defining a first side of said opening;

inserting a first pin through holes defined in said first frame member and a first pin-receiving one of said building blocks defining said first side of said opening and into a first cavity defined in said first pin-receiving block;

placing a second frame member adjacent said building blocks defining a second side of said opening;

inserting a second pin through holes defined in said second frame member and a second pin-receiving one of said building blocks defining said second side of said opening and into a second cavity defined in said second pin-receiving block;

placing a header frame member on top of said first and second frame members;

inserting a third pin through holes defined in a first end of said header frame member and a third pin-receiving one of said building blocks defining said first side of said opening and into a third cavity defined in said third pin-receiving block; and inserting a fourth pin through holes defined in a second end of said header frame member and a fourth pin-receiving one of said building blocks defining said second side of said opening and into a fourth cavity defined in said fourth pin-receiving block.

16. A method as defined in claim 9, further comprising connecting a baseboard to a groove defined along the bottom edge of said building blocks forming said lowermost course.

17. A method of manufacturing a kit for building a predesigned, pre-engineered structure having at least three different structural elements including a bottom building block, a middle building block and a top building block, said method comprising the steps of:

assigning a first color to said bottom building block;

assigning a second color to said middle building block;

assigning a third color to said top building block;

constructing a color-coded diagram depicting the finished structure, including placing first indicia on a first substratum showing the numbers and locations of said structural elements within said structure, said first indicia including a first rectangle having said first color for representing said bottom building block, a second rectangle having said second color for representing said middle building block, and a third rectangle having said third color for representing said top building block;

constructing a full-scale pattern depicting the layout of a plurality of the bottom building blocks, including placing second indicia on a second substratum showing the relative full-scale positions of the plurality of said bottom building blocks to be used in constructing a lowermost portion of said structure, said second substratum being disposable upon a foundation on which said structure is to be built;

fabricating a number of said bottom blocks, including the step of pigmenting said bottom blocks with said first color, said number of bottom building blocks being not less than the number of said bottom building blocks represented on said first substratum;

fabricating a number of said middle building blocks, including the step of pigmenting said middle building blocks with said second color, said number of middle building blocks being not less than the number of said middle building blocks represented on said first substratum; and fabricating a number of said top building blocks, including the step of pigmenting said top building blocks with said third color, said number of top building blocks being not less than the number of said top building blocks represented on said first substratum.

18. A method as defined in claim 9, further comprising the step of viewing a video tape giving pictorial and oral instructions for using the color-coded diagram, the pattern and the building blocks to construct the wall.

19. A method as defined in claim 17, further comprising the step of producing a video tape showing a person using the diagram, the pattern, and the building blocks to erect the predesigned, pre-engineered structure.

* * * * *